US012232602B1

(12) United States Patent
Zhang et al.

(10) Patent No.: US 12,232,602 B1
(45) Date of Patent: Feb. 25, 2025

(54) QUICK-SWITCHING WAIST BUCKLE FOR TOOL BAG

(71) Applicant: Zhangjiagang Prowin Import and Export Co., Ltd., Jiangsu (CN)

(72) Inventors: Jinhui Zhang, Jiangsu (CN); Chaoqun Ren, Jiangsu (CN)

(73) Assignee: Zhangjiagang Prowin Import and Export Co., Ltd., Suzhou (CN)

( * ) Notice: Subject to any disclaimer, the term of this patent is extended or adjusted under 35 U.S.C. 154(b) by 0 days.

(21) Appl. No.: 18/927,854

(22) Filed: Oct. 26, 2024

(51) Int. Cl.
*A45F 5/02* (2006.01)

(52) U.S. Cl.
CPC ..... *A45F 5/021* (2013.01)

(58) Field of Classification Search
CPC ..... A45F 5/021
See application file for complete search history.

(56) References Cited

U.S. PATENT DOCUMENTS

| | | | | |
|---|---|---|---|---|
| 9,826,819 | B2 | 11/2017 | Huang | |
| 2005/0045676 | A1* | 3/2005 | Bass | A45F 5/00 224/162 |
| 2022/0256980 | A1* | 8/2022 | Hörtnagl | A42B 3/08 |

* cited by examiner

*Primary Examiner* — David M Upchurch
(74) *Attorney, Agent, or Firm* — Ricky Lam

(57) ABSTRACT

The present disclosure provides a quick-switching waist buckle for a tool bag, including: a female component and a subcomponent fixed to the female component, the female component is a detachable buckle structure, the female component is fixed to the belt, the detachable subcomponent is fixed to the female component and used for fastening the tool bag. The fixing method between the female component and the belt can ensure that it will not separate from the belt, and the pressing unit can prevent the female component from sliding on the belt. The female component is fixed by pulling and fastening between the front and rear side plates for easy disassembly from the belt when needed. The front side plate on the female component and the fixing plate on the subcomponent can be quickly fixed by blind insertion.

3 Claims, 12 Drawing Sheets

QUICK-SWITCHING WAIST BUCKLE FOR TOOL BAG

FIELD

The present disclosure relates to the field of waist buckle, particularly to a quick-switching waist buckle for a tool bag.

BACKGROUND

The steeplejacks usually will carry their tools inside the tool bag, and in order to get the tools easily inside the tool bag, they will fix the tool bag to the belt through a waist buckle instead of using a backpack.

However, some tools placed inside the tool bag are sometimes difficult for the steeplejacks to quickly get due to their disorderly placement. In this case, the tool bag is required to be removed from the belt. The waist buckle will make it easy to separate between the tool bag and the belt.

Currently, the waist buckles often have the following problems when used. When the steeplejacks are working, it is inconvenient to look down and look for the tools inside the tool bag, and they need to separate the tool bag from the belt. However, the traditional waist buckle is not only cumbersome to operate, but also prone to drop from the belt. Besides, the separated tool bag is not convenient for steeplejacks to fix with the belt. The steeplejacks need to lower their heads to plug and install, which will affect their safety.

Therefore, in order to facilitate the steeplejacks to get the tools inside the tool bag and ensure the safety of steeplejacks, the present disclosure provides a quick-switching waist buckle for a tool bag.

SUMMARY

In view of the above issues, the present embodiment provides a quick-switching waist buckle for a tool bag to solve the above technical problems. In order to achieve the above objectives, the embodiments of the present disclosure provide the following technical solutions.

In one aspect of the embodiments of the present disclosure, a quick-switching waist buckle for a tool bag is provided, comprising: a female component and a subcomponent fixed to the female component, wherein the female component is a detachable buckle structure, the female component is fixed to a belt, and a detachable subcomponent is fixed to the female component, and the subcomponent is used for fastening and fixing the tool bag.

The female component comprises a front side plate, an upper end of the front side plate has a protruding structure with a buckle hole, a rear side plate is hinged on a rear side of the front side plate, and several sets of pressing units are arranged slidably on the rear side plate, a lower end of the rear side plate has a wedge-shaped structure, and one side where the front side plate and the rear side plate are in contact is provided with a limiting hole for the belt to pass through, and the pressing units are located inside the limiting hole, the front side plate has a cavity, and a pulling plate is arranged slidably inside the cavity, a rectangular groove is arranged in the middle of the pulling plate, and a spring is arranged inside the rectangular groove, with one end connected to an upper side wall of the rectangular groove and the other end connected to a bottom wall of the cavity, the pulling plate is provided with a locking hole that matches the wedge-shaped structure of the rear side plate, a protective cover is arranged on the outer wall of the cavity on the front side plate through bolts, and the protective cover is in sliding contact with the pulling plate.

In one embodiment, the subcomponent comprises a fixing plate, a trapezoidal hole is arranged in the middle of the fixing plate, and the wall of the trapezoidal hole is provided with a skirt edge for limiting the front side plate; two sets of guide holes are arranged on the fixing plate for fixing the tool bag, and a clamping unit is arranged between each set of guide holes, the upper end of the fixing plate is also provided with a raised block.

An installation cavity is provided inside the raised block, a gripping claw that matches the buckle hole on an upper end of the front side plate is arranged slidably inside the installation cavity.

One end of the gripping claw has a wedge-shaped structure; a cover plate is arranged on the outer wall of the installation cavity through the bolts, and the cover plate is connected to the gripping claw through a spring; an operating unit for pressing and matching the gripping claw is arranged inside the raised block.

In one embodiment, the rear side plate is uniformly provided with through holes, and the pressing unit comprises limiting columns symmetrically arranged on the wall of the through hole. A pressing plate with an arc-shaped structure is arranged slidably between the two limiting columns, and a spring that abuts against the pressing plate is sleeved on the outer wall of the limiting column.

In one embodiment, the raised block is equipped with a self-locking groove, including a circular groove and fan-shaped grooves symmetrically arranged on both sides of the circular groove with a slope, the operating unit includes a pushing rod arranged slidably inside the raised block, and the outer wall of the pushing rod is symmetrically arranged with a protrusion located inside the self-locking groove, a pressing block is arranged slidably inside the protrusion through the spring; and the clamping block abuts against one side of a wall of the fan-shaped groove away from the clamping unit.

In one embodiment, the clamping unit comprises a clamping block uniformly arranged slidably around the wall of the guide hole, the clamping block is an arc-shaped structure and an outer gear ring is also rotatably arranged on the fixing plate at a concentric position with the guide hole, an inner wall of the outer gear ring is provided with protrusions corresponding to the clamping block one by one, a rack rod that matches the outer gear ring is arranged on the outer side of each set of guide holes through a spring sliding on the fixing plate.

In one embodiment, the rack rod has an L-shaped structure, and a handle of the rack rod is a concave structure, the rack rod is stretched by a spring in the initial state to cause the protrusion to abut against the clamping block.

The fixing method between the female component and the belt ensures that the female component will not separate from the belt. The pressing unit can prevent the female component from sliding on the belt, and the female component is fixed by a buckle between the front and rear side plates for easy disassembly from the belt when needed; the front side plate on the female component and the fixing plate on the subcomponent can be quickly fixed by blind insertion. The skirt edge can maintain stability between the subcomponent and the female component without shaking.

In the present disclosure, the female component adopts a detachable structure to ensure that it can be separated from the belt, avoiding the situation where it cannot be separated due to jamming between the female component and the subcomponent. The front and rear side plates of the female component can be unlocked by pulling the pulling plate downwards, which can prevent steeplejacks from accidentally touching and separating the female component from the belt when getting tools.

DRAWINGS

The drawings herein are incorporated into and form part of the specification to show embodiments that conform to the application and are used together with the specification to explain the rationale of the application. At the same time, these drawings and descriptions are not intended in any way to limit the scope of the idea of the application, but rather to illustrate the concept of the application for persons skilled in the art by reference to specific embodiments.

Figure 1:
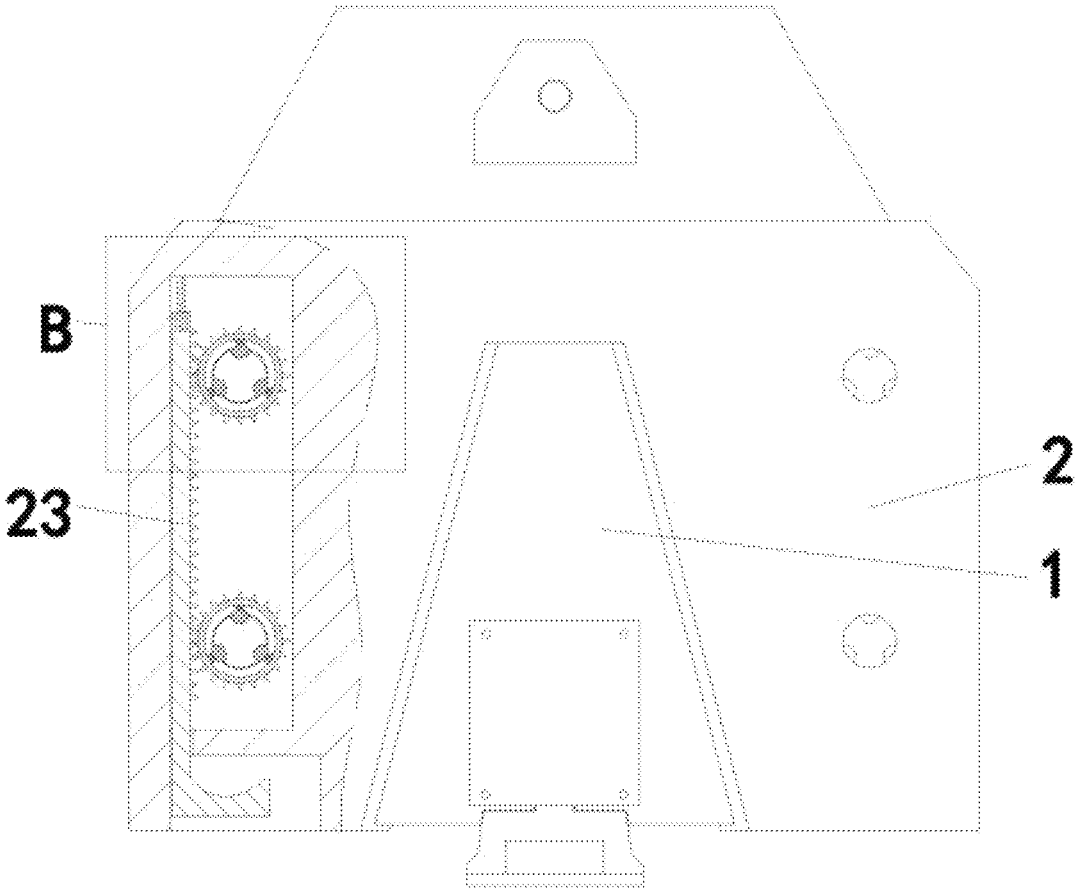
FIG. 1 is the structure of the quick-switching waist buckle used in the tool bag of the present disclosure.

1. Female component; 2. Subcomponents; 11. Front side plate; 12. Rear side plate; 13. Pressing unit; 14. Pulling plate; 15. Protective cover; 131. Limiting column; 132. Pressing plate; 21. Fixing plate; 22. Skirt edge; 23. Clamping unit; 24. Raised block; 25. Gripping claw; 26. Cover plate; 27. Operating unit; 231. Clamping block; 232. Outer gear ring; 233. Protrusions; 234. Rack rod; 241. Circular groove; 242. Fan-shaped groove; 271. Pushing rod; 272. Pressing block.

EMBODIMENT

The present disclosure will be further described in detail with Reference to FIGS. 1-12.

The present disclosure discloses a quick-switching waist buckle for a tool bag. Specifically, the quick-switching waist buckle for a tool bag is mainly used to quickly connect and fix the tool bag and the belt. The fixing method between the female component 1 and the belt can ensure that it will not separate from the belt. The pressing unit 13 can prevent the female component 1 from sliding on the belt. The female component 1 adopts a pull-out fixing method between the front side plate 11 and the rear side plate 12 for easy disassembly from the belt when needed. The front side plate 11 on the female component 1 and the fixing plate 21 on the subcomponent 2 can be quickly fixed by blind insertion. Besides, the skirt edge 22 can maintain stability between the subcomponent 2 and the female component 1 without shaking.

Figure 2:
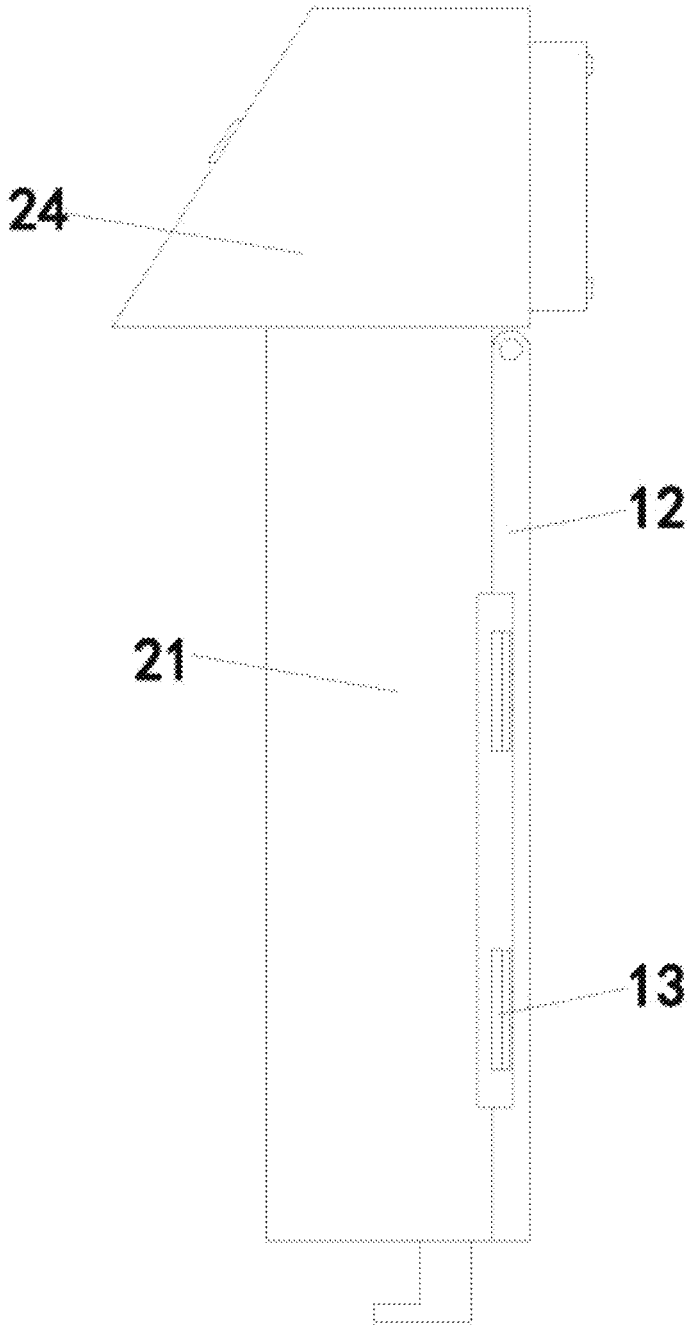
FIG. 2 is a side view of FIG. 1 of the present disclosure.

Refer to FIGS. 1 and 2, the quick-switching waist buckle for a tool bag comprises: a female component 1 and a subcomponent 2 that is connected with the female component 1. The female component 1 is a detachable buckle structure fixed to the belt. The detachable subcomponent 2 is fixed and inserted onto the female component 1, and the subcomponent 2 is used for fastening and fixing the tool bag.

Refer to FIGS. 2, 7, 8, and 10, the female component 1 includes a front side plate 11. An upper end of the front side plate 11 has a protruding structure with a buckle hole. A rear side plate 12 is hinged on a rear side of the front side plate 11. Several sets of pressing units 13 are arranged slidably on the rear side plate 12. The lower end of the rear side plate 12 has a wedge-shaped structure. The side where the front side plate 11 and the rear side plate 12 are in contact is provided with a limiting hole for the belt to pass through. The pressing unit 13 is located inside the limiting hole. A cavity is arranged inside the front side plate 11, and a pulling plate 14 is arranged slidably inside the cavity. A rectangular groove is arranged in the middle of the pulling plate 14. A spring is arranged inside the rectangular groove, with one end connected to the upper side wall of the rectangular groove and the other end connected to the bottom wall of the cavity. The pulling plate 14 is equipped with a locking hole that matches the wedge-shaped structure of the rear side plate 12. The wedge-shaped structure on the rear side plate 12 facilitates the inward pressing of the front side plate 11 without pulling the pulling plate 14, allowing the wedge-shaped structure of the rear side plate 12 to freely enter the locking hole for fixation. The outer wall of the cavity located on the front side plate 11 is equipped with a protective cover 15 through bolts, and the protective cover 15 is in sliding contact with the pulling plate 14.

Figure 9:
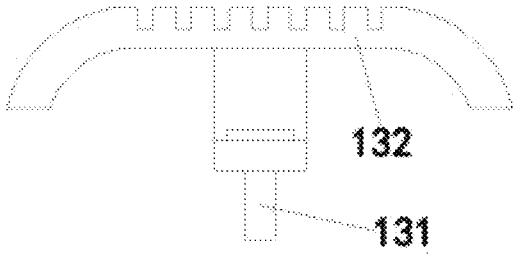
FIG. 9 is a top view of the pressing unit.
Figure 10:
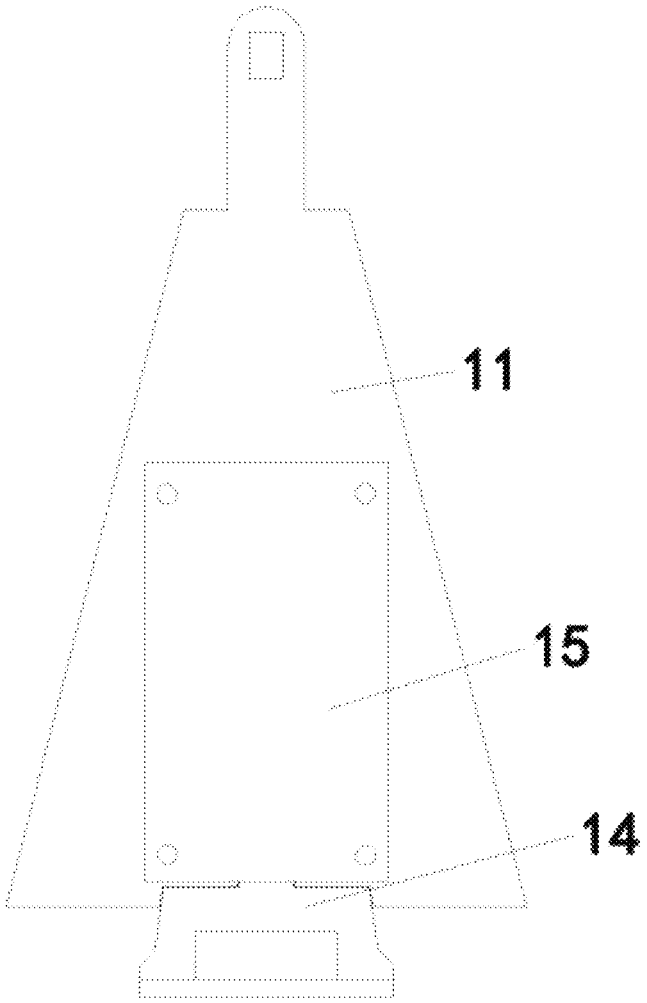
FIG. 10 is a front view of the female component of the present disclosure.
Figure 12:
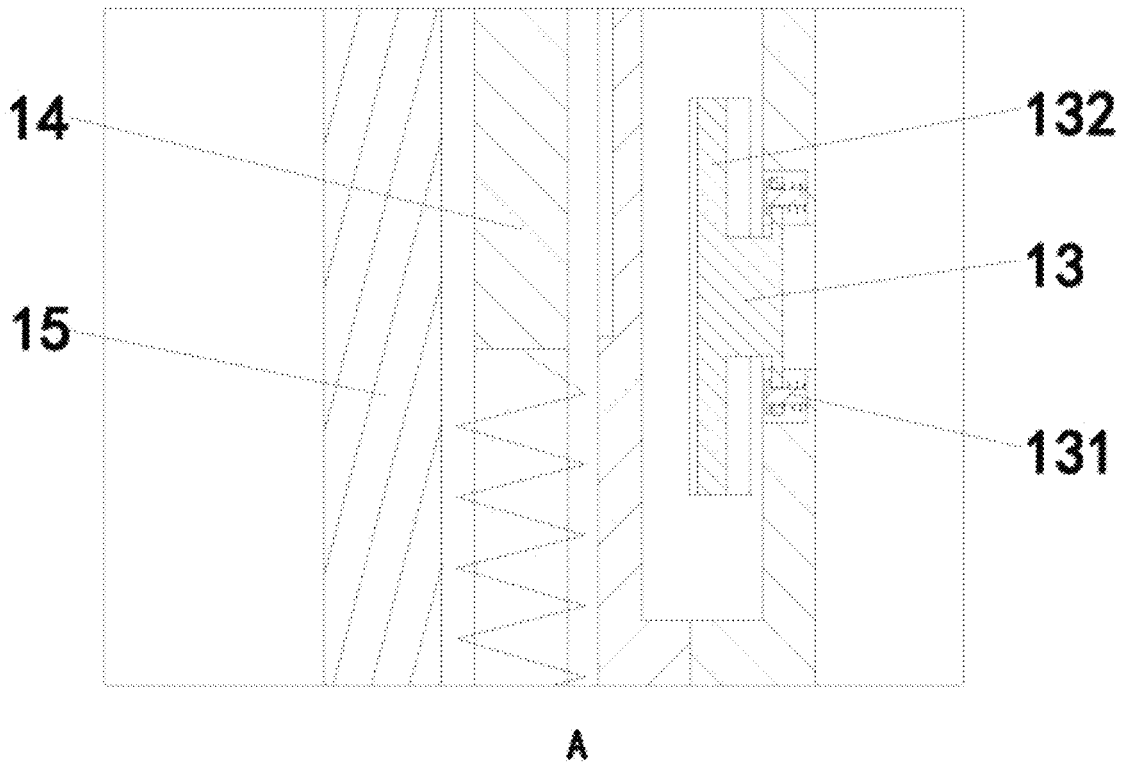
FIG. 12 is an enlarged partial view of point A in FIG. 8 of the present disclosure.

Refer to FIGS. 9 and 12, the rear side plate 12 is uniformly provided with through holes, and the pressing unit 13 includes limiting columns 131 symmetrically arranged on the wall of the through hole. A pressing plate 132 with an arc-shaped structure is sliding between the two limiting columns 131. The outer wall of the limiting column 131 is provided with a spring that abuts against the pressing plate 132.

When using the female component 1, firstly, the front side plate 11 and the rear side plate 12 are fastened by the pulling plate 14 as a whole. Then, the belt is passed through the front side plate 11 and the rear side plate 12, and the belt is limited by the pressing unit 13 to prevent the female component 1 from moving as a whole. The pressing unit 13 uses a spring to resist the pressing plate 132, so that the outer wall of the pressing plate 132 abuts against the belt, increasing the friction between the pressing plate 132 and the belt, thereby ensuring that the female component 1 will not move on the belt. The female component 1 can be unattached to ensure that it can be separated from the belt, avoiding the situation where the female component 1 and the subcomponent 2 are stuck and cannot be separated. In addition, the front side plate 11 and the rear side plate 12 in the female component 1 can be unlocked by pulling down the pulling plate 14, and unlocking by pulling down can prevent steeplejacks from accidentally touching and separating the female component 1 from the belt when getting tools.

Figure 4:
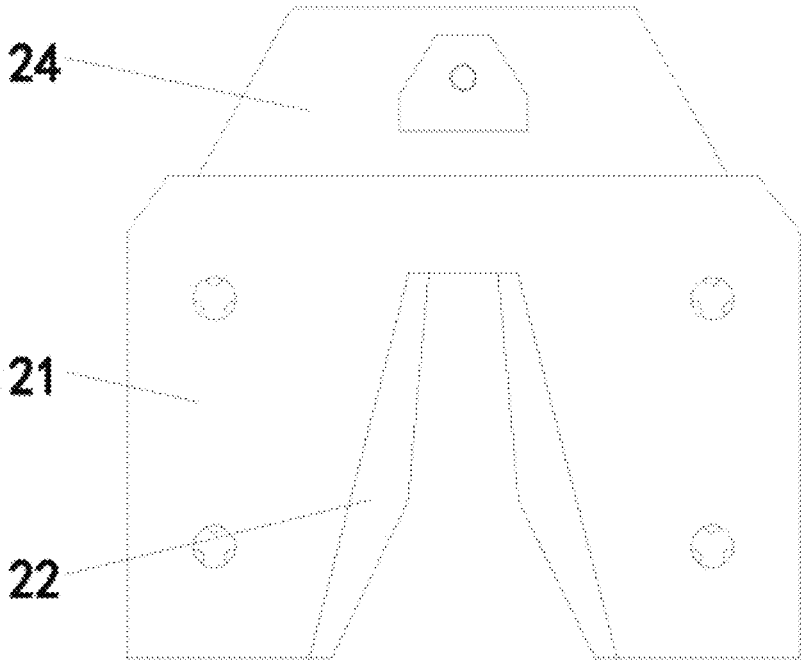
FIG. 4 is a front view of a subcomponent of the present disclosure.
Figure 5:
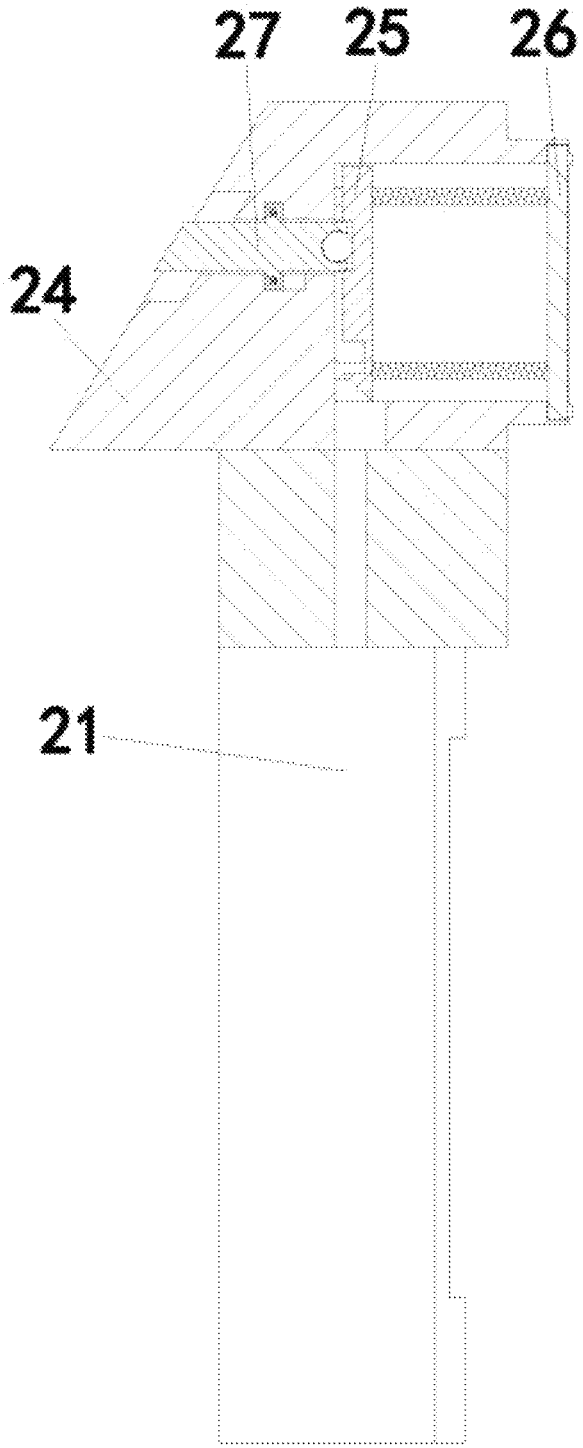
FIG. 5 is a sectional view of the side view of the subcomponent of the present disclosure.

Refer to FIGS. 2, 4, and 5, the subcomponent 2 includes a fixing plate 21, with a trapezoidal hole in the middle of the fixing plate 21, and the hole wall of the trapezoidal hole is provided with a skirt edge 22 for limiting the front side plate 11. Two sets of guide holes are provided on the fixing plate 21 for fixing the tool bag, and a clamping unit 23 is arranged between each set of the guide holes. The upper end of the fixing plate 21 is also provided with a raised block 24, and an installation cavity is arranged inside the raised block 24. A gripping claw 25 that matches the buckle hole on an upper end of the front side plate 11 is arranged slidably in the installation cavity. The end of the gripping claw 25 has a wedge-shaped structure. The outer wall of the installation cavity is equipped with a cover plate 26 through bolts, and the cover plate 26 is connected to the gripping claw 25 through a spring that abuts against it. The raised block 24 is provided with an operating unit 27 for pressing and matching the gripping claw 25.

Figure 6:
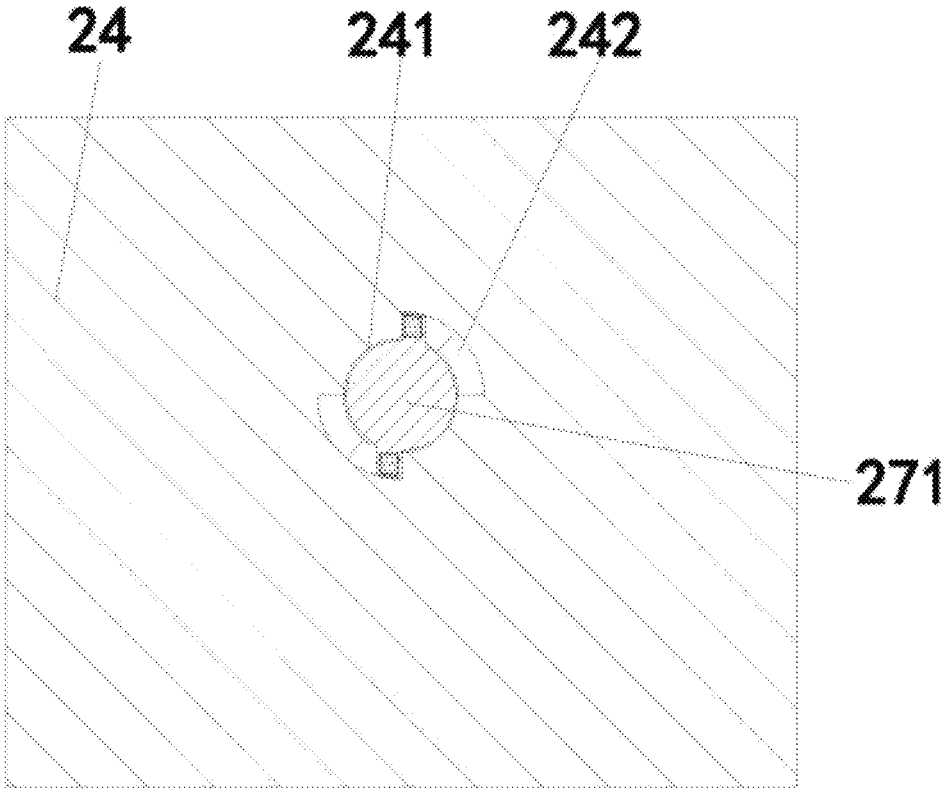
FIG. 6 is a sectional view between the operating unit and the self-locking groove of the present disclosure.
Figure 7:
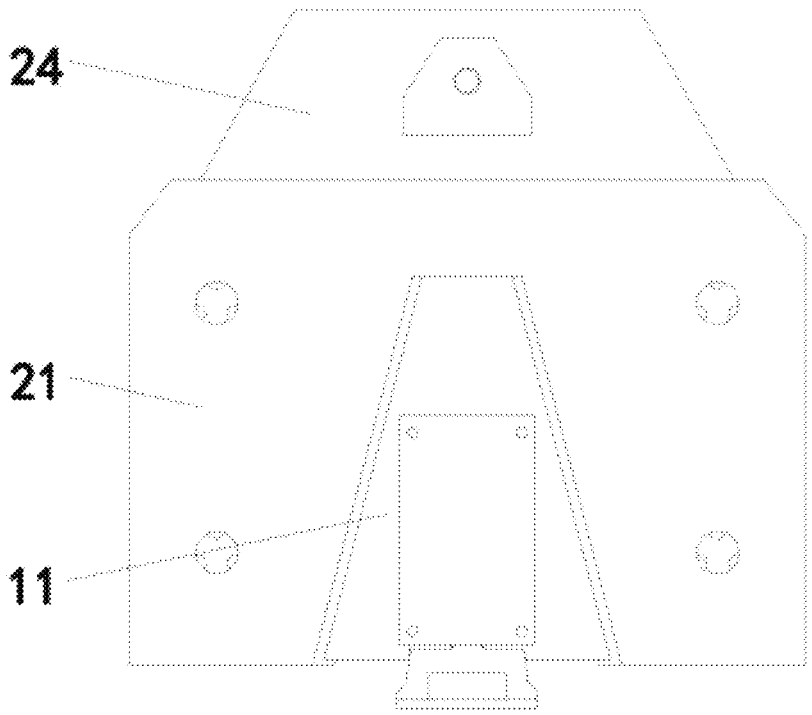
FIG. 7 is a front view of the present disclosure.
Figure 8:
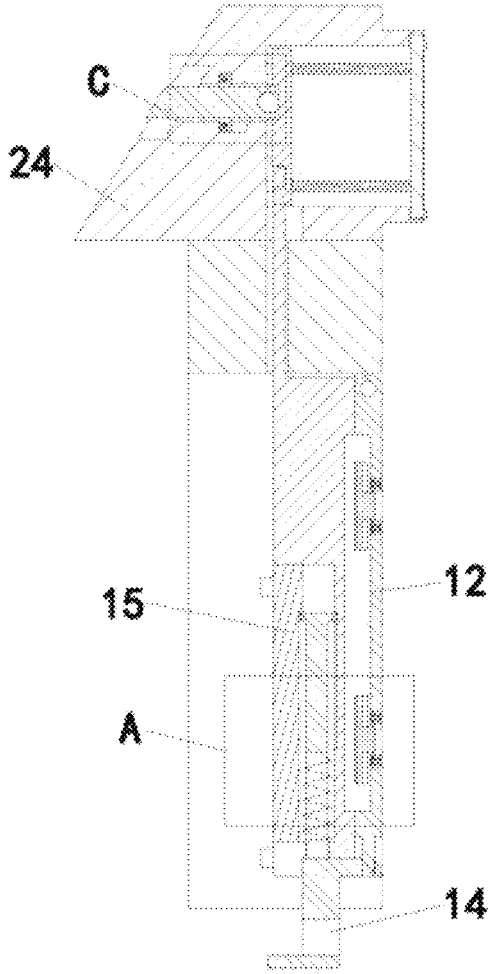
FIG. 8 is a side sectional view of FIG. 7 of the present disclosure.
Figure 11:
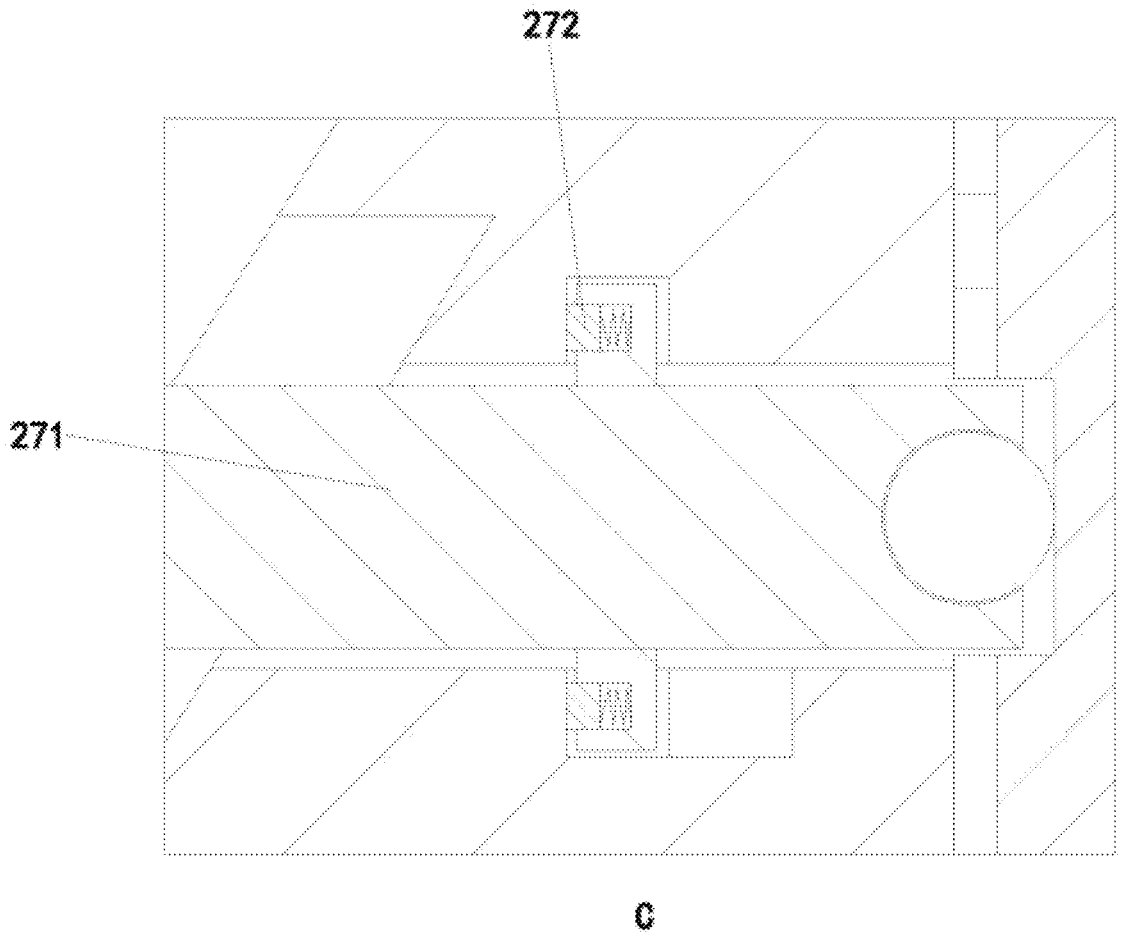
FIG. 11 is an enlarged partial view of point C in FIG. 8 of the present disclosure.

Refer to FIGS. 6 and 11, the raised block 24 is provided with a self-locking groove, including a circular groove 241 and a fan-shaped groove 242 symmetrically arranged on both sides of the circular groove 241 with a certain slope. The operating unit 27 includes a pushing rod 271 arranged slidably inside the raised block 24, and the outer wall of the pushing rod 271 is symmetrically arranged with a protrusion located inside the self-locking groove. A pressing block 272 is arranged slidably inside the protrusion through a spring. Besides, the pressing block 272 abuts against one side of the groove wall of the fan-shaped groove 242 which is away from the clamping unit 23.

Figure 3:
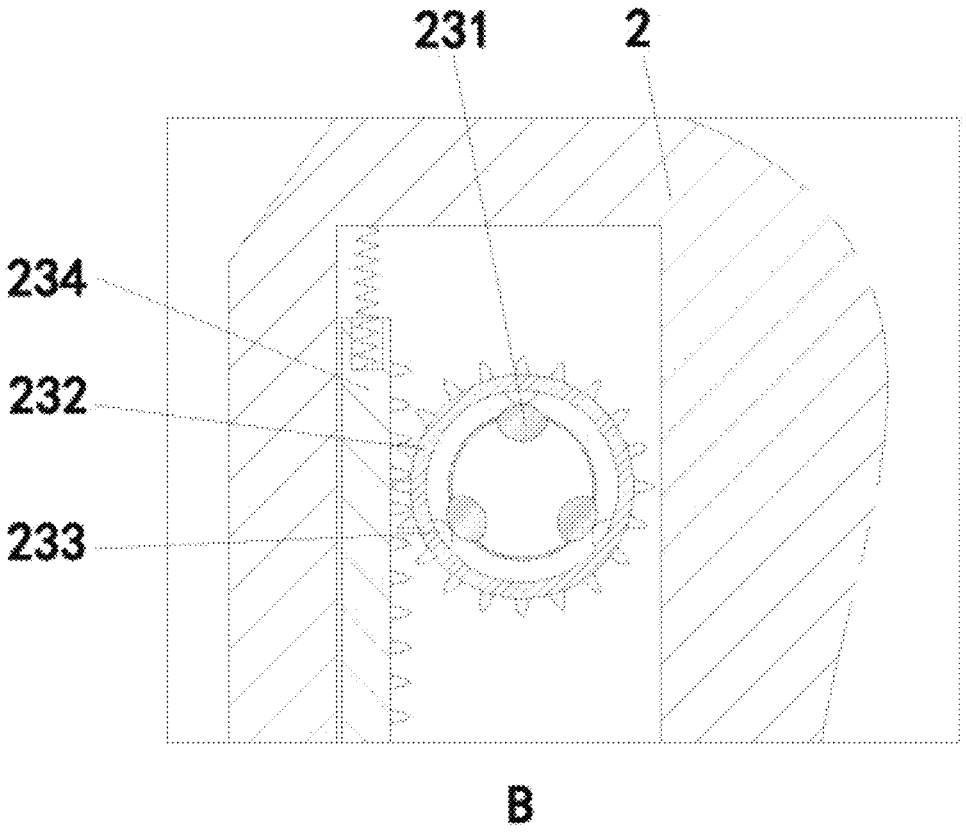
FIG. 3 is an enlarged partial view of point B in FIG. 1 of the present disclosure.

Refer to FIG. 3, the clamping unit 23 includes clamping blocks 231 uniformly arranged slidably around the wall of the guide hole. The clamping blocks 231 are arc-shaped and are located on the fixing plate 21 at the same position as the guide hole. An outer gear ring 232 is also rotatably arranged on the inner wall of the outer gear ring 232, and protrusions 233 corresponding to the clamping blocks 231 are arranged one by one. A rack rod 234 that matches the outer gear ring 232 is arranged slidably on the outer side of each set of guide holes on the fixing plate 21 through a spring. The rack rod 234 is L-shaped, and the handle of the rack rod 234 is a concave structure. In the initial state, the rack rod 234 is stretched by a spring to cause the protrusions 233 to abut against the clamping block 231.

When fastening the tool bag to the subcomponent 2, the rack rod 234 is pulled down to drive the outer gear ring 232 firstly, further causing the protrusions 233 to be misaligned and separated from the clamping block 231. Then, the tool bag with the locking column is inserted into the guide hole of the fixing plate 21, and finally the rack rod 234 is released to fix the tool bag to subcomponent 2. During daily use, the steeplejacks can put the tools into the tool bag and then directly insert the subcomponent 2 connected to the tool bag into the female component 1. Specifically, when inserting, the skirt edge 22 can be pressed against the front side plate 11 and then the subcomponent 2 is pushed downwards as a whole, so that the gripping claw 25 abuts against the protruding structure on the front side plate 11. During this process, the gripping claw 25 will move and the gripping claw 25 fits with buckle hole to complete the locking process. It can be unlocked between the subcomponent 2 and the female component 1 through the operating unit 27. When unlocking, the pushing rod 271 is first rotated to make the symmetrical protrusion on the pushing rod 271 leave the fan-shaped groove 242, and then the pushing rod 271 can be pressed to move. By moving the pushing rod 271, the gripping claw 25 is disengaged from the buckle hole. In the normal locked state, the protrusion is located inside the fan-shaped groove 242 and abuts against the wall of the fan-shaped groove 242 through the spring abutting against the pressing block 272, which can maintain the stability of the pushing rod 271 and prevent it from tilting and shaking.

The above description is only an embodiment of the present disclosure and does not limit the scope of the present disclosure. Any equivalent structure or equivalent process transformation made using the specification and the drawings in the present disclosure, or directly or indirectly applied in other related technical fields, are also included in the protection scope of the present disclosure.

What is claimed is:

1. A quick-switching waist buckle for a tool bag, comprising:

a female component (1) and a subcomponent (2) plugged with the female component (1), wherein, the female component (1) is a detachable buckle structure fixed to a belt, the subcomponent (2) is plugged into the female component (1) and used for fastening the tool bag;

the female component (1) comprises a front side plate (11), an upper end of the front side plate (11) has a protruding structure with a buckle hole, a rear side plate (12) is hinged on a rear side of the front side plate (11), and several sets of pressing units (13) are arranged slidably on the rear side plate (12), a lower end of the rear side plate (12) has a wedge-shaped structure, and one side where the front side plate (11) and the rear side plate (12) are in contact is provided with a limiting hole for the belt to pass through, and the pressing units (13) are located inside the limiting hole, the front side plate (11) has a cavity, and a pulling plate (14) is arranged slidably inside the cavity, a rectangular groove is arranged in the middle of the pulling plate (14), and a spring is arranged inside the rectangular groove, with one end connected to an upper side wall of the rectangular groove and the other end connected to a bottom wall of the cavity, the pulling plate (14) is provided with a locking hole that matches the wedge-shaped structure of the rear side plate (12), a protective cover (15) is arranged on the outer wall of the cavity on the front side plate (11) through bolts, and the protective cover (15) is in sliding contact with the pulling plate (14);

the subcomponent (2) comprises a fixing plate (21), a trapezoidal hole is arranged in the middle of the fixing plate (21), and a wall of the trapezoidal hole is provided with a skirt edge (22) for limiting the front side plate (11);

two sets of guide holes are arranged on the fixing plate (21) for fixing the tool bag, and a clamping unit (23) is provided between each set of the guide holes, the upper end of the fixing plate (21) is also provided with a raised block (24), and an installation cavity is provided inside the raised block (24), a gripping claw (25) that matches the buckle hole on an upper end of the front side plate (11) is arranged slidably inside the installation cavity, and one end of the gripping claw (25) has a wedge-shaped structure; a cover plate (26) is arranged on the outer wall of the installation cavity through the bolts, and the cover plate (26) is connected to the gripping claw (25) through a spring; an operating unit (27) for pressing and matching the gripping claw (25) is arranged inside the raised block (24);

the raised block (24) is equipped with a self-locking groove, including a circular groove (241) and fan-shaped grooves (242) symmetrically arranged on both sides of the circular groove (241) with a slope, the operating unit (27) includes a pushing rod (271) arranged slidably inside the raised block (24), and the outer wall of the pushing rod (271) is symmetrically arranged with a protrusion located inside the self-locking groove, a pressing block (272) is arranged slidably inside the protrusion through the spring; and the pressing block (272) abuts against one side of a wall of the fan-shaped groove (242) away from the clamping unit (23);

the clamping unit (23) comprises a clamping block (231) uniformly arranged slidably around the wall of the guide hole, the clamping block (231) is an arc-shaped structure and an outer gear ring (232) is also rotatably arranged on the fixing plate (21) at a concentric position with the guide hole, an inner wall of the outer gear ring (232) is provided with protrusions (233) corresponding to the clamping block (231) one by one, a rack rod (234) that matches the outer gear ring (232) is arranged on the outer side of each set of guide holes through a spring sliding on the fixing plate (21).

2. The quick-switching waist buckle for a tool bag according to claim 1, wherein a through hole is uniformly provided on the rear side plate (12), and the pressing unit (13) comprises limiting columns (131) symmetrically arranged on a wall of the through hole, and a pressing plate (132) with an arc-shaped structure is arranged slidably between the two limiting columns (131), and an outer wall of the limiting column (131) is provided with a spring that abuts against the pressing plate (132).

3. The quick-switching waist buckle for a tool bag according to claim 1, wherein the rack rod (234) has an L-shaped structure, and a handle of the rack rod (234) is a concave structure, the rack rod (234) is stretched by a spring in the initial state to cause the protrusions (233) to abut against the clamping block (231).

* * * * *